US009980593B2

(12) United States Patent
Pajonas

(10) Patent No.: US 9,980,593 B2
(45) Date of Patent: May 29, 2018

(54) MAILBOX, MAILBOX PROTECTION APPARATUS, AND METHOD

(71) Applicant: Todd R. Pajonas, Easton, CT (US)

(72) Inventor: Todd R. Pajonas, Easton, CT (US)

(73) Assignee: Todd R. Pajonas, Easton, CT (US)

( * ) Notice: Subject to any disclaimer, the term of this patent is extended or adjusted under 35 U.S.C. 154(b) by 0 days. days.

(21) Appl. No.: 15/367,398

(22) Filed: Dec. 2, 2016

(65) Prior Publication Data

US 2017/0156533 A1 Jun. 8, 2017

Related U.S. Application Data

(60) Provisional application No. 62/263,699, filed on Dec. 6, 2015.

(51) Int. Cl.
*A47G 29/12* (2006.01)

(52) U.S. Cl.
CPC ..... *A47G 29/1209* (2013.01); *A47G 29/1216* (2013.01)

(58) Field of Classification Search
CPC .. A47G 29/1216; A47G 29/122; A47G 29/30; A47G 29/1209; A47G 29/1203
USPC ..... 232/17, 38, 39, 1 C, 29; 404/6; 40/606.06
See application file for complete search history.

(56) References Cited

U.S. PATENT DOCUMENTS 5,411,206 A * 5/1995 Latham ..... A47G 29/1216 232/39
5,460,326 A * 10/1995 Albanesius ..... A47G 29/1216 232/17
D365,190 S * 12/1995 Albanesius ..... D99/43
6,962,460 B1 * 11/2005 Pratt ..... G09F 7/00 248/636
6,974,073 B1 * 12/2005 Snyder ..... A47G 29/1203 232/1 C
7,080,773 B1 * 7/2006 Tepley ..... A47G 29/1216 232/17
8,794,505 B1 * 8/2014 Richardson ..... A47G 29/1216 232/1 C
8,925,225 B2 * 1/2015 Fiore ..... A47G 29/122 232/39
9,549,632 B2 * 1/2017 Pickens ..... A47G 29/122
2006/0186188 A1 * 8/2006 Belanger ..... A47G 29/1209 232/38
2007/0138249 A1 * 6/2007 Webber ..... A47G 29/1216 232/39
2008/0314967 A1 * 12/2008 Black ..... A47G 29/1216 232/39
2016/0073812 A1 * 3/2016 Pickens ..... A47G 29/122 232/38
2017/0156533 A1 * 6/2017 Pajonas ..... A47G 29/1209

* cited by examiner

*Primary Examiner* — William Miller
(74) *Attorney, Agent, or Firm* — Dilworth IP LLC

(57) ABSTRACT

An apparatus for use on a mailbox having a substantially vertical side, includes a first panel; a second panel; a hinge joining the first panel and the second panel; an angle limiter; and a mounting device for securing the apparatus to the mailbox. A mailbox is improved by mounting on the box an apparatus having a panel to provide a surface oriented to tangentially receive the impact of substantially horizontally-directed debris directed toward the mailbox.

5 Claims, 3 Drawing Sheets

MAILBOX, MAILBOX PROTECTION APPARATUS, AND METHOD

CROSS-REFERENCE TO RELATED APPLICATION

This application claims the benefit of U.S. provisional application No. 62/263,699 filed Dec. 6, 2015, which is incorporated herein by reference in its entirety.

FIELD OF THE INVENTION

The present disclosure relates generally to mailboxes and more specifically it relates to a protection apparatus for improving the durability of a prior art mailbox.

BACKGROUND AND RELATED ART

The U.S. Postal Service has defined "curbside mailboxes" as any design for a mailbox made to be served by a carrier from a vehicle on any city, rural or highway route.

A common design for a curbside mailbox is shown in FIG. 1A. The mailbox 100 comprises a container 101 mounted on a post 102. The container 101 is defined by a top member 104 formed sheet of metal which provides two parallel, vertically-oriented side walls 106, 108 with a dome-shaped roof portion 110 in between the side walls. The bottom edges of the side walls 106, 108 are riveted to a bottom panel (not shown) which provides the floor of the box 100. The side walls 106, 108 and roof portion 110 leave open ends at the front and rear of the container 101. The front end of the box (the end nearest the road) is closable by virtue of a door 112 attached to the bottom panel by a hinge. The rear end of the container 101 is closed by an end panel (not shown) which may be soldered, riveted or otherwise fixed to the top member 104 and the bottom panel. A flag 114 on wall 108 is movable by hand from a horizontal position to a vertical position to enable communication between the mail customer and the mail carrier through movement of the flag from one position to the other.

Another, less common prior art curbside mailbox 150 is shown in FIG. 1B. Mailbox 150 is configured as a right triangular prism having a first side 152, a second side 154 and a hypotenuse side 156. As shown, the first side extends horizontally from the intersection with the second side 154 to serve as the bottom panel. The second side 154 extends vertically upward from the first side at a relative angle of about 90 degrees. The hypotenuse side 156 which faces oncoming traffic, slants downward from the top of the second side 154 to meet the distal edge of the first side 152. The mailbox 150 has two ends, including a front end 158 which includes a door 160 for inserting or removing delivered items. There is a second door 162 in the second side 154.

SUMMARY OF THE INVENTION

An apparatus comprises an angled panel component comprising a first panel and a second panel joining the first panel at a joint to form an angle between them; a support bracket on the second panel, the support bracket being between the second panel and the first panel; and a mounting device for securing the apparatus to a mailbox.

According to one optional aspect, the support bracket may be dimensioned and configured to cooperate with the second panel to define a seat for receiving a mailbox.

In another aspect, the second panel has a distal edge opposite from the joint and the support bracket has an upward-extending surface positioned on the second panel to define a seat for receiving a mailbox.

According to yet another aspect, the joint comprises at least one hinge and the apparatus further comprises an angle limiter. Optionally, the angle limiter interconnects the first panel and the second panel.

In still another aspect, the second panel may comprise a support bracket.

Optionally, the support bracket is dimensioned and configured to cooperate with the second panel to define a seat for receiving a mailbox.

In another aspect, the invention relates to an improved mailbox comprising a container having an apparatus as described herein, mounted thereon, such that a panel of the apparatus is oriented to tangentially receive the impact of substantially horizontally-directed debris directed toward the mailbox when the bottom panel is disposed horizontally. A method of protecting a mailbox having a substantially vertical side, comprises mounting on the mailbox at least one panel oriented to tangentially receive the impact of substantially horizontally-directed debris directed toward the substantially vertical side of the mailbox.

Still another aspect of the invention relates to a mailbox having at least one side oriented to tangentially receive the impact of substantially horizontally-directed debris directed toward the mailbox.

DETAILED DESCRIPTION

Figure 1A:
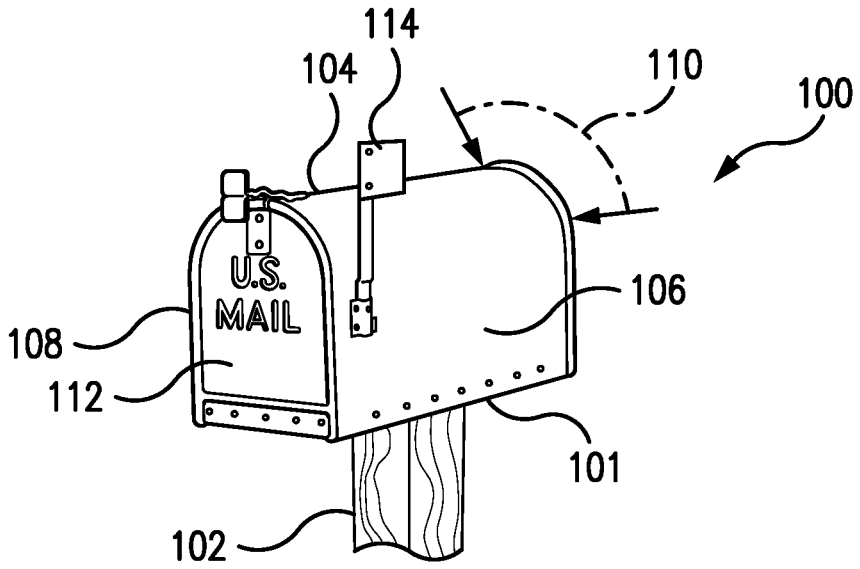
FIG. 1A (PRIOR ART)
FIG. 1A is a perspective view of a prior art curbside mailbox, mounted on a post.
Figure 1B:
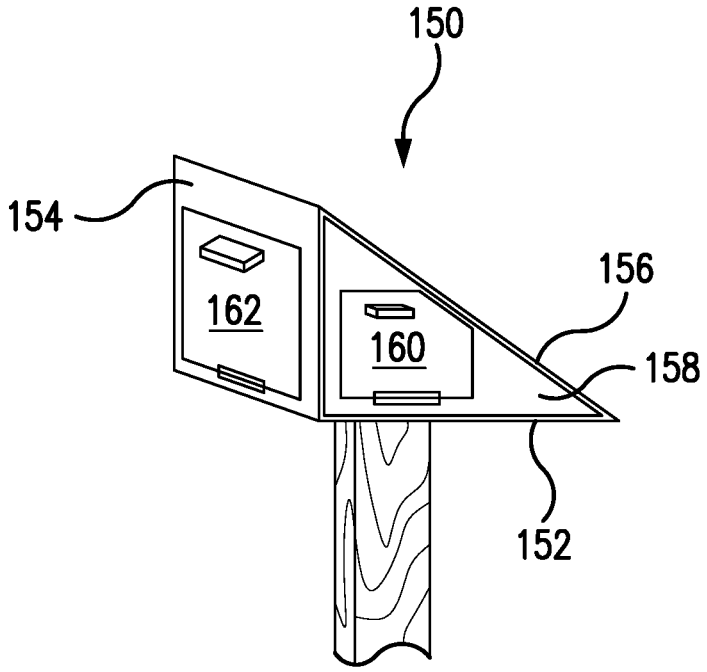
FIG. 1B (PRIOR ART)
FIG. 1B is a perspective view of another prior art curbside mailbox, mounted on a post.
Figure 2:
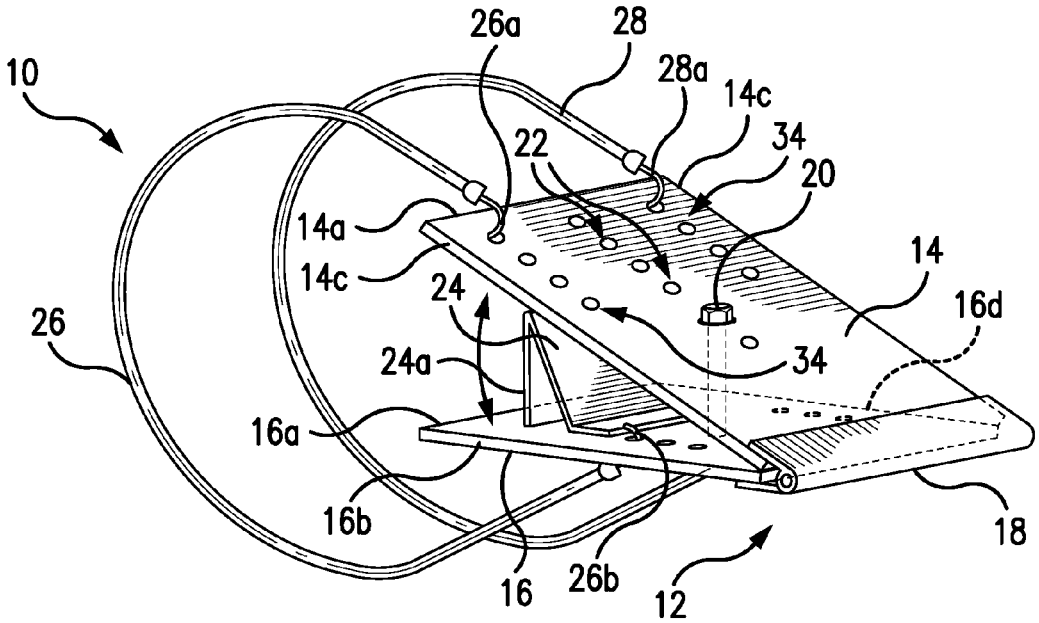
FIG. 2 is a schematic perspective view of an apparatus according to one embodiment of the invention.
Figure 3:
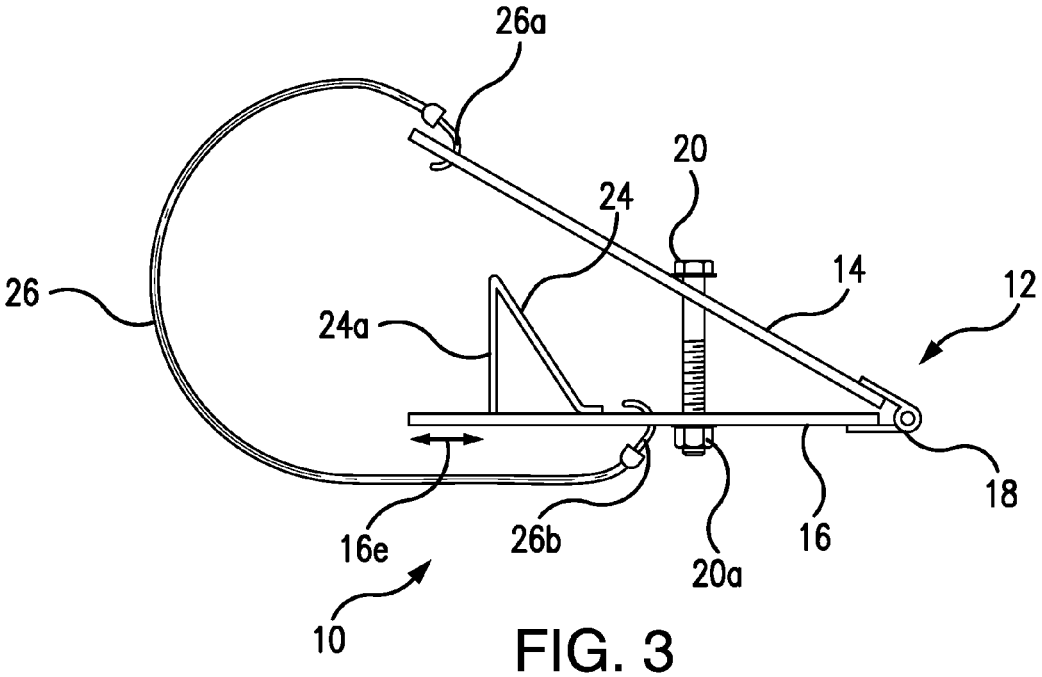
FIG. 3 is a schematic elevation view of the apparatus of FIG. 2.

This disclosure arises from the Applicant's observation that many curbside mailboxes are subject to damage and other trauma due to impact of snow, ice, slush, mud, gravel, and other debris propelled toward the mailbox from the nearby ground by snowplows, passing vehicles and individuals. Taking box 100 as an example, if side 106 is facing oncoming traffic, that side will bear the brunt of impact from debris kicked up by passing vehicles and striking the mailbox, often at a substantially horizontal angle. In one aspect, this disclosure relates to an apparatus which can be attached to any type of mailbox to ameliorate the effect of such debris. FIG. 2 and FIG. 3 provide views of an illustrative first embodiment of such an apparatus.

The apparatus 10 of FIG. 2 and FIG. 3 provides an angled panel component 12 comprised of a first panel 14 and a second panel 16 joined to the first panel at a joint provided by a hinge 18 which interconnects the first panel and the second panel along their mutually proximal edges. In the illustrated embodiment, the first panel 14 and second panel 16 are each rectangular panels of durable material, e.g., an impact resistant plastic or laminate, or a sheet metal similar to the metal from which the mailbox may be formed. Some embodiments may be made from metal of a heavier gauge than the mailbox, e.g., 16 ga (about 1.5 millimeters; 0.06 inches). The first panel 14 and the second panel 16 each has a distal edge 14*a*, 16*a*, respectively, opposite from the hinge 18, and first and second end edges 14*b*, 14*c* and 16*b* and 16*c* (FIG. 5), respectively. The hinge 18 enables the first panel 14 and the second panel 16 to swing relative to each other, defining various planar angles between them with the apex along the hinge.

In one embodiment, the apparatus 10 includes an angle limiter to limit the degree to which the first panel 14 and the second panel 16 can swing away from each other, limiting the angle between them to a non-reflex angle. In the illustrated embodiment, the angle limiter is a T-bolt 20 received through holes in the first panel 14 and the second panel 16 respectively, and secured thereto by a nut 20*a* at the bottom of the second panel, to interconnect the panels and limit their rotation away from each other about the hinge. However, the invention is not limited in this regard and in other embodiments, other angle limiters can be used, e.g., a length of chain or twine secured between the first panel 14 and the second panel 16 may limit their relative movement. The angle limiter may optionally limit the relative motion of the first panel 14 and the second panel 16 to a relative angle of not more than 90 degrees, optionally not more than 60 degrees; for example about 45 degrees, but the invention is not limited to any particular angle. By adjusting the length of the angle limiter between the first panel 14 and the second panel 16, the opening between the respective distal edges 14*a*, 16*a* resulting from the angle between the panels can be set so that in use, the apparatus can be installed on a mailbox as described elsewhere herein.

As shown, the T-bolt 20 is received through a hole in the first panel 14 and a hole in the second panel 16 respectively. Optionally, there may be a plurality of holes 22 located centrally between the end edges 14*b* and 14*c* (and, optionally, corresponding holes in second panel 16), in which the T-bolt can be received, so that the maximum angle permitted by the T-bolt can be varied by varying its distance from the hinge 18 as well as by positioning the nut. In other embodiments, the angle limiter can be adjusted in other ways, e.g., by adjusting the length of a chain-type angle limiter.

The second panel 16 carries a support bracket 24 situated between the second panel and the first panel 14. The support bracket 24 provides a fixed upward-extending surface 24*a* which rises from the top surface of the second panel 16 and extends toward the first panel 14. In the illustrated embodiment, the support bracket 24 is configured to that the upward-extending surface 24*a* is perpendicular to the second panel 16, but the precise angular orientation of the upward-extending surface relative to the second panel is not critical. In addition, the support bracket 24 is positioned at a place on the second panel that is proximal to, but removed from, the edge 16*a* so that a lip 16*e*, FIG. 3, of the second panel 16 extends past the support bracket away from the hinge and so provides a seat where a lower edge of a mailbox (i.e., the joint between the bottom panel and lower part of a side) can be received. For example, the lip 16*e* may have a depth of about 2 centimeters (cm) to about 5 cm (about 0.75 inches (in.) to about 2 in.) from the edge 16*a*. The height of surface 24*a* above the second panel 16 should be about ⅔ of the height of the mailbox 100. In the illustrated embodiment, the support bracket 24 is formed from a triangular member joined to the second panel 16 at a central region of the second panel 16 closer to hinge 18 to provide support for the upward-extending surface 24*a*. However, the invention is not limited in this regard and in other embodiments, a support bracket may be configured simply as an angle bracket mounted on the second panel 16 with a single upright portion rising therefrom.

A mounting device is provided to hold the angled panel component 12 on a mailbox. In the illustrated embodiment, the mounting device comprises a first elastic band 26 having a hook 26*a*, 26*b* on each end, and an optional second elastic band 28 having a hook 28*a*, 28*b* (FIG. 5) on each end. The first hook 26*a* on the first elastic band 26 is inserted into a hole on the first panel 14 he second hook 26*b* is disposed in a hole in the second panel 16. Similarly, the first hook 28*a* on the second elastic band 28 is inserted into a hole on the first panel 14 and the second hook 28*b* is disposed in a hole in the second panel 16.

Optionally, there is a series of holes in the first panel 14 or the second panel 16, optionally in both panels, for receiving the hooks, so that the user can select the placement of the hooks as will be described. Thus, in the illustrated embodiment, there is a plurality of holes 34 along the end edge 14*c* and 14*d* of panel 14 and a plurality of corresponding holes alone each end edge of panel 16. However, the invention is not limited in this regard and in other embodiments, there may only be a single hole for the hook on one panel while there is a plurality of corresponding holes on the other panel.

Figure 4:
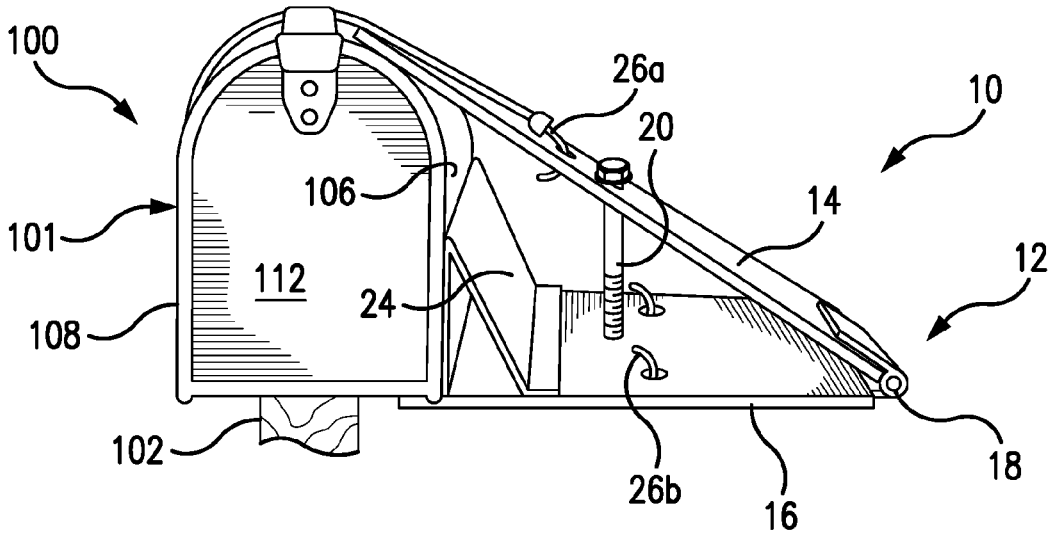
FIG. 4 is a schematic perspective view of the apparatus of FIG. 2 on the mailbox of FIG. 1.
Figure 5:
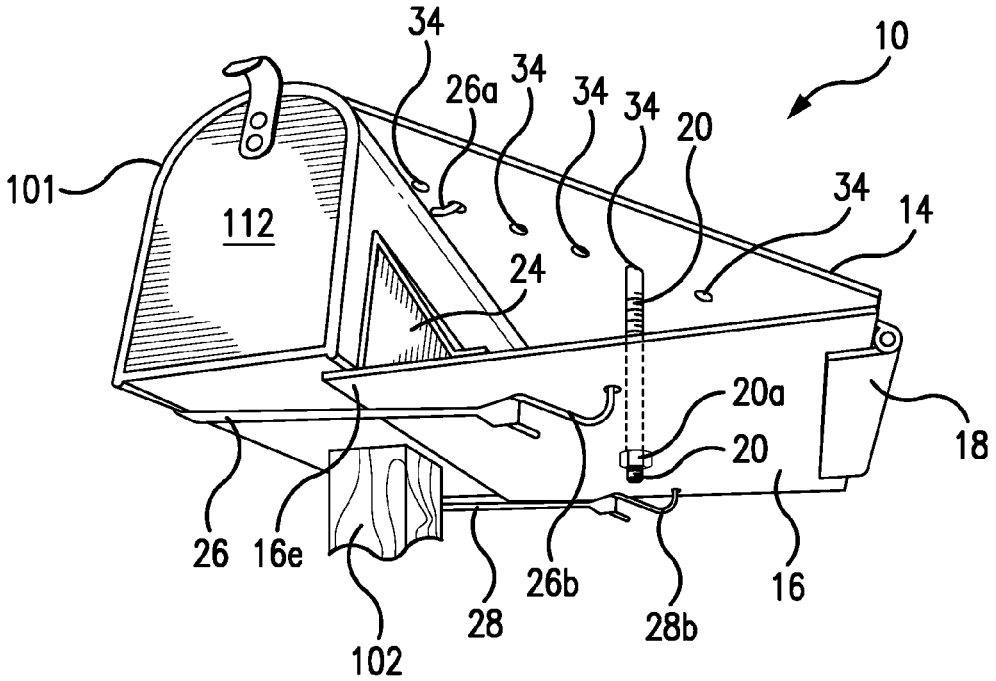
FIG. 5 is another schematic perspective view of the apparatus of FIG. 2 on the mailbox of FIG. 1.

FIG. 4 and FIG. 5 provide views of the apparatus 10 mounted on the conventional mailbox 100, which itself is mounted on a post 102. As shown, the container 101 is seated against the second panel 16 and the support bracket 24, and the first panel 14 rests against the roof portion 110 of the mailbox. In a particular embodiment, the distal portion of lower surface of the first panel 14 carries a contact material, e.g., a rubber or vinyl coating, to engage the surface of the container 101. Optionally, the contact material is a non-abrasive material to protect the surface of the container 101 from damage due to movement of the first panel 14 on the mailbox. Advantageously, the contact material may have a slip-resistant surface for contact with the container 101 to help keep the apparatus 10 in place on the mailbox despite the impact of debris or other forces.

The first elastic band 26 and second elastic band 28 have their first hooks secured in holes in the first panel 14 and they are stretched around the container 101 in order to insert the second hooks into holes in the second panel 16. The tension in the first elastic band 26 and in the second elastic band 28 pulls the angled panel component 12 toward the container 101 and the support bracket 24 provides a stop to limit the movement of the second panel 16. The angle limiter (T-bolt 20) prevents the first panel 14 from swinging away from the second panel 16 and so, in cooperation with the support bracket 24, fixes the position and orientation of the angled panel component 12 relative to the container 101.

In the illustrated embodiment the mounting device comprises elastic bands, stretched around the container 101 with hooks secured into holes selected to provide an appropriate level of tension, but the invention is not limited in this regard and in other embodiments, the mounting device may comprise non-elastic straps, or twine, or other binding material secured to the angled panel component 12 to secure the angled panel component onto the container 101. Similarly, while the elastic bands are connected to the first panel 14 and the second panel 16 by hooks, the invention is not limited in this regard and in other embodiments, the mounting device may be joined to the panels in other ways known in the art, e.g., straps may be looped through slots in the panels, and may be cinched tight using buckles, hook-and-loop fastening, or by other conventional means.

Preferably, the apparatus 10 is mounted on the side of the mailbox 100, preferably on the side which faces oncoming traffic in the nearest lane on the roadway along which the mailbox is positioned. In this way, as an approaching vehicle tosses up a spray of sand, ice, etc., the flying debris will strike the apparatus 10, and in particular the first panel 14, rather than the side of the container 101. The angular configuration of the apparatus 10 allow the apparatus to receive impacts of the substantially horizontally-direct debris tangentially, rather than straight-on, as would the vertical side 106 of the container 101. Thus the apparatus 10 will be less affected by the debris than the container 101 would be, and will prevent damage to the mailbox. However, the invention is not limited in this regard and the apparatus will serve to protect the mailbox from debris directed at the side of the mailbox from any angle. Accordingly, the apparatus 10 will have utility when attached to a mailbox having side which might be angled somewhat off from vertical.

It will be understood by one of ordinary skill in the art that the use of apparatus 10 is not limited to round-topped prior art mailboxes such as mailbox 100. Rather, apparatus 10 can be mounted on most mailboxes by positioning the lip 16*e* and support bracket 24 against the bottom and side of the mailbox, respectively, resting the first panel 14 against the top of the mailbox, and securing the apparatus to the mailbox with a mounting device, e.g., one or more straps or bands that wrap around the mailbox from the first panel 14 to the second panel 16 to hold the apparatus in place against the mailbox.

Another aspect of the invention relates to a method for extending the usefulness of a curbside mailbox having a vertical or substantially vertical side, in particular a side facing oncoming traffic, the method comprising mounting at least one panel oriented to tangentially receive the impact of substantially horizontally-directed debris directed toward the substantially vertical side of the mailbox. Optionally, the method comprises mounting on the mailbox an apparatus to provide angled baffles to shield the mailbox from debris, wherein the apparatus comprises an angled panel component to provide an angularly disposed surface to tangentially receive the impact of the substantially horizontally impinging debris.

Details of the preferred embodiment and others have been provided, but the invention is not limited to the disclosed features, and variations apparent to those of ordinary skill in the art after reading and understanding of this disclosure should be recognized as being within the spirit and scope of the invention as claimed. For example, although the angled panel component 12 is described and illustrated as being hinged at the joint between the panels, the invention is not limited in this regard and in other embodiments, the first panel 14 and the second panel 16 may be joined fixedly along their edges (e.g., riveted to an angle rod, or soldered, glued or welded together at the joint between them, or they may be portions of a single, larger bent panel wherein the joint is simply a transition seam.) In such fixed-angle embodiments, the angle limiter may not be needed.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The drawings featured in the figures are provided for the purposes of illustrating some embodiments of the present invention, and are not to be considered as limitation thereto.

The terms "first," "second," and the like, herein do not denote any order, quantity, or importance, but rather are used to distinguish one element from another. The terms "a" and "an" herein do not denote a limitation of quantity, but rather denote the presence of at least one of the referenced item.

Although the invention has been described with reference to particular embodiments thereof, it will be understood by one of ordinary skill in the art, upon a reading and understanding of the foregoing disclosure, that numerous variations and alterations to the disclosed embodiments will fall within the scope of this invention and of the appended claims.

What is claimed is:

1. An apparatus for a mailbox comprising:

an angled panel component comprising a first panel and a second panel joining the first panel at a joint to form an angle between them;

a support bracket on the second panel, the support bracket being between the second panel and the first panel; and a mounting device for securing the apparatus to the mailbox;

wherein the joint comprises a hinge and the apparatus further comprises an angle limiter which interconnects the first panel and the second panel.

2. The apparatus of claim 1 wherein the support bracket is dimensioned and configured to cooperate with the second panel to define a seat for receiving the mailbox.

3. The apparatus of claim 2 wherein the second panel has a distal edge opposite from the joint and the support bracket has an upward-extending surface positioned on the second panel to define the seat for receiving the mailbox.

4. An improved mailbox comprising:

a container having a bottom panel; and an apparatus mounted on the container, the apparatus comprising:

an angled panel component comprising a first panel and a second panel joining the first panel at a joint to form an angle between them;

a support bracket on the second panel, the support bracket being between the second panel and the first panel; and a mounting device securing the apparatus to the container;

wherein the first panel is oriented to tangentially receive the impact of substantially horizontally-directed debris directed toward the mailbox when the second panel is disposed horizontally;

wherein the support bracket is dimensioned and configured to cooperate with the second panel to define a seat for receiving the container; and wherein the joint comprises a hinge and the angled panel component further comprises an angle limiter which interconnects the first panel and the second panel.

5. The mailbox of claim 4 wherein a portion of the second panel extends from the support bracket away from the joint to define the seat for receiving the container.

* * * * *